US007225797B2

(12) United States Patent
Zdroik

(10) Patent No.: US 7,225,797 B2
(45) Date of Patent: Jun. 5, 2007

(54) REMOTELY MOUNTED FUEL SYSTEM

(75) Inventor: Michael J. Zdroik, Metamora, MI (US)

(73) Assignee: Millennium Industries Corp., Auburn Hills, MI (US)

( * ) Notice: Subject to any disclaimer, the term of this patent is extended or adjusted under 35 U.S.C. 154(b) by 0 days.

(21) Appl. No.: 11/250,218

(22) Filed: Oct. 14, 2005

(65) Prior Publication Data

US 2007/0084446 A1 Apr. 19, 2007

(51) Int. Cl.
*F02M 37/20* (2006.01)
*F02M 37/00* (2006.01)

(52) U.S. Cl. ..... 123/516; 123/509

(58) Field of Classification Search ..... 123/516, 123/509, 510, 511, 514, 518, 520; 417/423.9, 417/423.15

See application file for complete search history.

(56) References Cited

U.S. PATENT DOCUMENTS 4,971,017 A 11/1990 Beakley et al.
4,979,482 A * 12/1990 Bartlett ..... 123/510
5,740,784 A 4/1998 McKinney
5,832,903 A 11/1998 White et al.
6,009,859 A * 1/2000 Roche et al. ..... 123/509
6,112,725 A 9/2000 McKinney
6,158,975 A 12/2000 Dill et al.
6,494,226 B2 * 12/2002 Tipton et al. ..... 137/1
6,553,974 B1 * 4/2003 Wickman et al. ..... 123/516
6,792,966 B2 * 9/2004 Harvey ..... 137/265
7,089,917 B1 * 8/2006 McKinster et al. ..... 123/509
2005/0005915 A1 * 1/2005 Saito ..... 123/516
2006/0048757 A1 * 3/2006 Harvey ..... 123/516

* cited by examiner

*Primary Examiner*—Mahmoud Gimie
(74) *Attorney, Agent, or Firm*—Dykema Gossett PLLC

(57) ABSTRACT

A fuel system comprises a fuel tank having an outlet. The system further includes a reservoir having a housing defining a cavity. The reservoir is located remotely from the tank and is configured to receive and store fuel. The system still further includes a fuel pump having an inlet and outlet. The system yet still further includes a valve having a fuel tank inlet port, a reservoir inlet port and an outlet port. The fuel tank inlet port is in fluid communication with the fuel tank, the reservoir inlet port is in fluid communication with the reservoir and the outlet port is configured to be connected to and in fluid communication with the fuel pump. The valve is configured to couple the outlet port with the reservoir inlet port when predetermined conditions occur indicative of fuel vapor air in the fuel tank inlet port.

19 Claims, 3 Drawing Sheets

REMOTELY MOUNTED FUEL SYSTEM

BACKGROUND OF THE INVENTION

1. Field of the Invention

This invention relates to a fuel system, and more particularly, to a remote mounted fuel system used, for example, in marine applications.

2. Disclosure of Related Art

Fuel systems supplying fuel to engines, such as marine engines, face a variety of obstacles in ensuring that the engine runs smoothly with little or no degradation in performance. For instance, boat fuel tanks are often exposed to heat caused by exposure to the sun or from simply running the engine for a relatively long period of time. When fuel tanks are exposed to this excessive amount of heat, the liquid fuel (i.e., gasoline) in the tank, engine, fuel system components and fuel lines feeding the engine, can vaporize. When this happens the resulting vapor is fed into the fuel pump and blocks or impedes the flow of liquid fuel, thereby causing a condition known as "vapor lock". Vapor lock can have the effect of causing the engine to stutter or stall or it may prevent it from being started or restarted due to the lack of fuel being supplied to the engine. When this occurs, the system often must be allowed to cool down in order to dissipate the vapor and remove the vapor lock condition.

Another instance that presents obstacles to the smooth running of engines, and marine engines in particular, is ingestion of air in the fuel system. When boats are in the water, waves may cause the boat to rock back and forth. Similarly, a boat may make maneuvers such as banking when turning at a high rate of speed or quickly accelerating or decelerating. In each instance the fuel in the fuel tank and other components of the fuel system sloshes around, thereby causing the system to ingest air. When this air enters the fuel system, it has the same or similar effect on the engine as vapor does in a vapor lock condition. Accordingly, the air can cause the engine to seize or otherwise degrade performance.

Conventional fuel systems attempt to solve the system degradation problem by employing vapor traps in the fuel system or by otherwise venting the system. Still other conventional fuel systems attempt to solve the problem by trying to prevent the fuel in the system from sloshing around. These systems are not without their disadvantages, however. For instance, vapor traps may fail, and thus, be unsuccessful in sufficiently ridding the system of vapor, thereby resulting in vapor lock or reduced performance. Similarly, fuel will slosh around to a certain degree and create air pockets regardless of the steps taken to prevent it. Additionally, the fuel tanks will still undoubtedly be exposed to heat, thereby causing fuel to vaporize regardless of the steps taken to prevent air pockets caused by sloshing fuel.

Accordingly, it is desirable to provide a fuel system that will minimize and/or eliminate one or more of the above-identified deficiencies.

SUMMARY OF THE INVENTION

The present invention is directed towards a fuel system. A fuel system in accordance with the present invention comprises a fuel tank having an outlet. The fuel system includes a reservoir having a housing that serves to define a cavity therein. The reservoir is located remotely from the fuel tank and is configured to receive and store fuel therein.

The inventive fuel system further includes a fuel pump having an inlet and an outlet and that is configured to supply fuel to an engine from either the fuel tank or the reservoir to an engine. The inventive fuel supply still further includes a valve. The valve includes a fuel tank inlet port in fluid communication with the fuel tank, a reservoir inlet port in fluid communication with the reservoir, and an outlet port configured to be connected to, and in fluid communication with, the fuel pump. The valve is configured to couple the outlet port with the reservoir inlet port when predetermined conditions occur that are indicative of fuel vapor or air in the fuel tank inlet port.

These and other features and objects of this invention will become apparent to one skilled in the art from the following detailed description and the accompanying drawings illustrating features of this invention by way of example.

DETAILED DESCRIPTION OF THE PREFERRED EMBODIMENT

Figure 1:
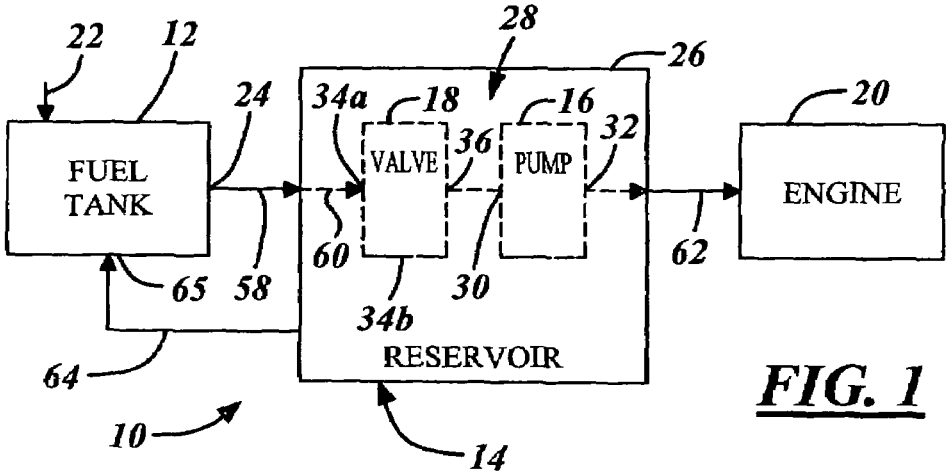
FIG. 1 is schematic block diagram view of a preferred embodiment of the present invention.

Referring now to the drawings wherein like reference numerals are used to identify identical components in the various views, FIG. 1 illustrates one embodiment of a fuel system 10 for a marine vessel, such as a boat, in its simplest form. It should be noted that while fuel system 10 is described in detail as being a fuel system for a marine vessel, fuel system 10 is not so limited. Rather, fuel system 10 can be used in any number of applications, such as, for example, land vehicles and other fuel driven engine applications.

At the most basic level, fuel system 10 comprises a fuel tank 12, a reservoir 14, a fuel pump 16, and a valve 18. Fuel tank 12 is configured to store fuel (i.e., gasoline) and to supply the fuel stored therein to an engine 20. Typically boat fuel tanks have a capacity of 20–100 gallons. In a preferred embodiment, fuel tank 12 comprises at least one inlet 22 to allow for the filling of tank 12, as well as at least one outlet 24 to allow for the fuel in tank 12 to be supplied to engine 20. Fuel tank 12 may further include one or more internal baffles that prevent the fuel in tank 12 from sloshing around, thereby creating undesirable air pockets in the fuel.

Figure 2:
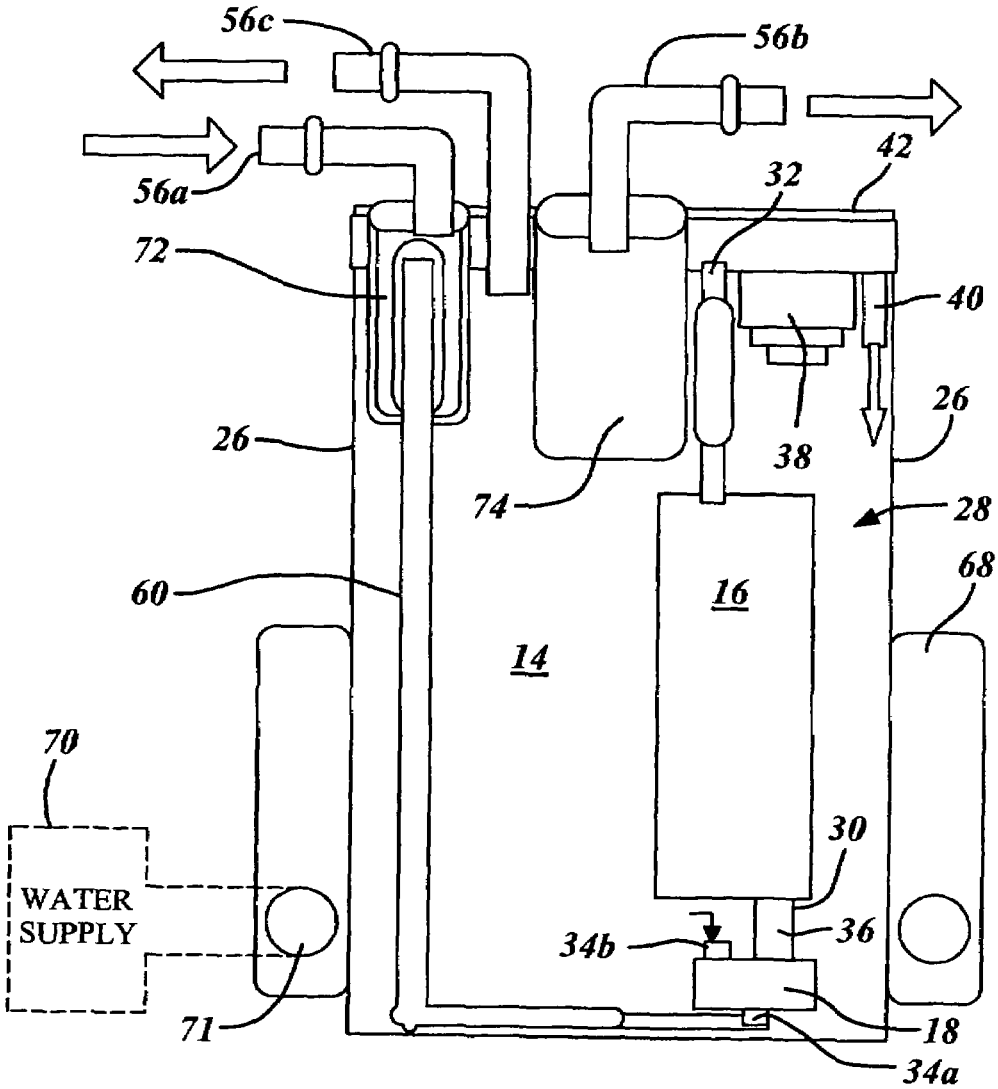
FIG. 2 is a diagrammatic view of a preferred embodiment of the present invention.

Reservoir 14 includes a housing 26 defining a cavity 28 therein and, in a preferred embodiment, is located separate from fuel tank 12. Housing 26 is typically constructed of metal, such as for example, aluminum or fabricated steel. However, housing 26 may also be constructed of other materials, such as, for exemplary purposes only, plastic. As illustrated in FIGS. 1 and 2, housing 26 is also configured to house, among other components, fuel pump 16 and valve 18. Reservoir 14, and cavity 28, in particular, is configured to receive and store fuel (i.e., gasoline), as well as to selectively supply the fuel stored therein in engine 20. In one exemplary embodiment, reservoir 14 has a capacity of approximately one liter of liquid. However, those skilled in the art will recognize that reservoir 14 may have a greater or lesser capacity. As discussed above, fuel in marine vessel fuel tanks often sloshes around as the boat makes maneuvers, such as making a banked turn or accelerating/decelerating quickly, causing the formation of air pockets. The fuel in the tank may also vaporize when exposed to heat from the sun or otherwise. In either scenario, the pockets and/or vapor prevent fuel from being pulled by the fuel pump and supplied to the engine, thereby causing the engine to seize or otherwise perform below standards. As will be discussed in greater detail below, reservoir 14 serves as an alternate fuel source for engine 20 when a predetermined amount of vapor is present in either the fuel tank 12 or the fuel line between tank 12 and pump 16.

With continued reference to FIGS. 1 and 2, in one preferred embodiment, fuel pump 16 is mounted and disposed within cavity 28 of reservoir 14, and thus, is located remotely from fuel tank 12. Fuel pump 16 includes an inlet 30 and an outlet 32, and is operative to pump fuel stored in either fuel tank 12 or reservoir 14 to engine 20. Fuel pump 16 is an electrically driven pump that is powered, in one exemplary embodiment, by the electrical system of the boat. In one exemplary embodiment, pump 16 is a standard electronic fuel injector (EFI) pump having a pressure rating of 300 to 500 kPa (43–73 psi) and a flow rate of 60 to 200 liters/hr (16–53 gph). It should be noted, however, that those skilled in the art will recognize that pumps having greater or lesser pressure and flow ratings remain within the spirit and scope of the present invention.

In the illustrated embodiment shown in FIG. 2, valve 18 is also mounted and disposed within cavity 28, and is arranged so as to be positioned between fuel tank 12 and fuel pump 16. Accordingly, the combination of fuel pump 16 and valve 18 being mounted within reservoir 14 creates a single modular component that can be connected between fuel tank 12 and engine 20. Valve 18 is configured to select from which source (i.e., fuel tank 12 and reservoir 14) fuel pump 16 pulls fuel to supply to engine 20. In one preferred embodiment, valve 18 includes a pair of inlet ports 34*a*, 34*b* and an outlet port 36. Inlet port 34*a* is configured to be connected to, and in fluid communication with, outlet 24 of fuel tank 12. Inlet port 34*b* is in fluid communication with cavity 28 of reservoir 14. Outlet port 36 is configured to be connected to, and in fluid communication with, inlet 30 of fuel pump 16. As will be discussed in greater detail below, in this embodiment valve 18 is a pressure sensitive valve commonly referred to as a "Delta P" valve and is operative to select from which source fuel pump 16 pulls fuel based on the differential pressure between the fuel in fuel tank 12 and the fuel in reservoir 14. It should be noted, however, that while a "Delta P" valve is described in depth, other types of pressure sensitive valves can be used in its place.

Figure 3A:
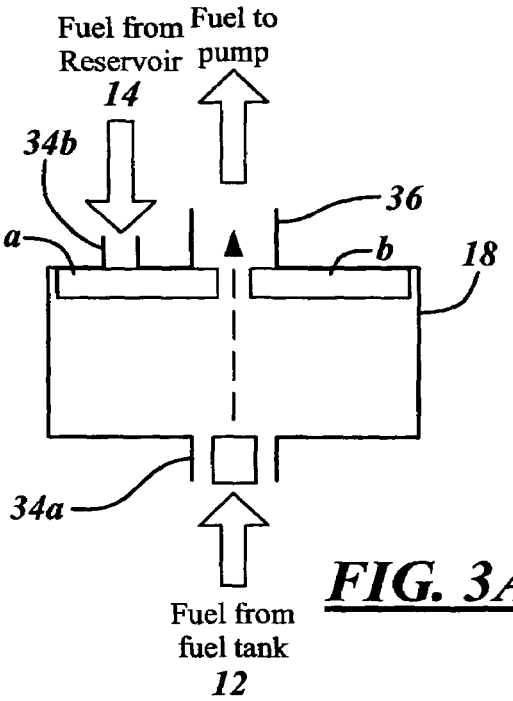
FIGS. 3*a*–3*b* are diagrammatic views of a valve in accordance with the present invention.
Figure 3B:
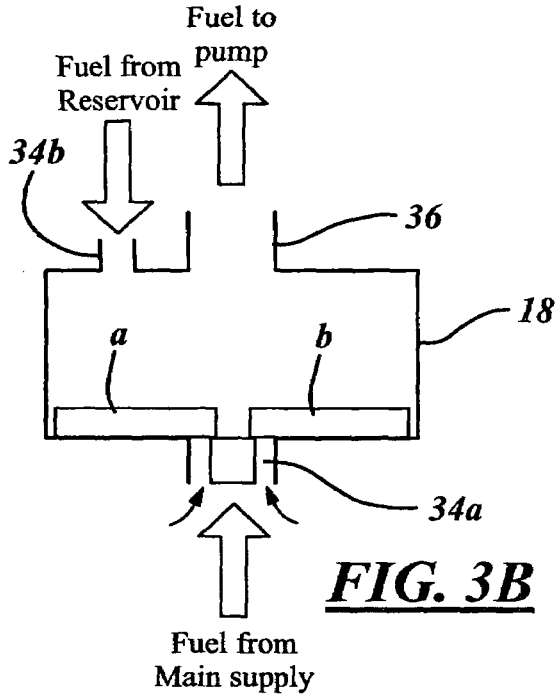

As discussed above, in the present invention, fuel can be supplied to engine 20 from either fuel tank 12 or reservoir 14. During a first state of operation (PRIMARY), fuel is pulled by fuel pump 16 from tank 12 and supplied to engine 20. With reference to FIGS. 3*a* and 3*b*, when fuel is available in tank 12, pump 16 can create enough change in pressure to open (i.e., lift) pressure valve 18 and pull the fuel from tank 12 (see FIG. 3*a*). In this instance, valve 18 serves to seal off the flow of fuel from reservoir 14 through inlet port 34*b* to pump 16. That is, in the PRIMARY state of operation the fuel in tank 12 is liquid. Thus, operation of pump 16 acts to develop a differential pressure across valve 18, opening port 34*a* and closing port 34*b*.

When a predetermined amount of vapor is present in tank 12, or in the fuel line between tank 12 and pump 16, system 10 transitions to a second state of operation (BACKUP). In the BACKUP state, pump 16 cannot create enough change in pressure to pull fuel from tank 12, and so valve 18 closes (i.e., falls). When this occurs, valve 18 seals off the flow of fuel and vapor from tank 12 through inlet port 34*a*, and thus, the fuel in reservoir 14 is pulled by pump 16 (see FIG. 3*b*). When the vapor level in tank 12 sufficiently dissipates, pump 16, now being able to draw liquid fuel from tank 12, will again develop a sufficient differential pressure to trigger the switching of inlets, opening port 34*a*, closing port 34*b*, and thus, allowing the fuel in tank 12 to be pulled by pump 16 and supplied to engine 20. When the system is in an intermediate state such that there is not enough loss of pressure to completely switch valve 18 from tank 12 to reservoir 14, valve 18 switches back and forth between the two fuel sources.

Valve 18 may be adjusted to change the point at which the valve switches from one fuel source to the other. One method of adjustment is to change the orifice size in valve 18 to control the amount of fuel entering the valve. A second way is adjusting the weight of the valve such that more pressure is required to lift it. In another embodiment, valve 18 is spring biased such that the tension of the spring can be adjusted to change the amount of force required to compress the spring, and thus, switch between fuel sources.

This fuel source switching arrangement prevents losses resulting from, among other things, hot fuel flow or vapor lock, and therefore, improves and maintains the performance of engine 20. It should be noted that the configuration of pressure valve 18 described above is for exemplary and descriptive purposes only and is not meant to be limiting in nature. Those skilled in the art will recognize that valve 18 may be configured in a number of different ways depending on the packaging and available room within reservoir 14.

In one preferred embodiment, fuel system 10 further includes a fuel pressure regulator 38 that is seated in a receptacle 39. Regulator 38 has an inlet and an outlet, is connected between fuel pump outlet 32 and engine 20 and is operative to regulate or control the amount of fuel supplied to engine 20 by pump 16 (best shown in FIGS. 2 and 4). Regulator 38 further includes a bypass outlet 40, which is provided to allow any fuel not needed by engine 20 to spill or flow into and fill cavity 28. In fuel systems like fuel system 10, when the pressure of the fuel supplied to engine 20 by pump 16 reaches and/or exceeds a predetermined set operating level, regulator 38 bypasses the excess fuel supplied by pump 16 to reservoir 14 through bypass outlet 40. Accordingly, regulator 38 monitors the pressure of the fuel supplied to engine 20 to ensure that the fuel supplied to the engine maintains a set, predetermined, pressure.

Figure 4:
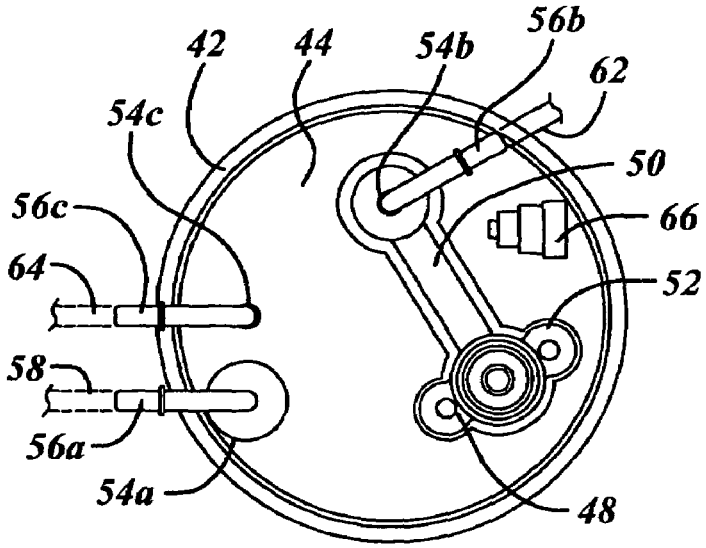
FIG. 4 is a top plan view of a fuel manifold in accordance with the present invention.
Figure 5:
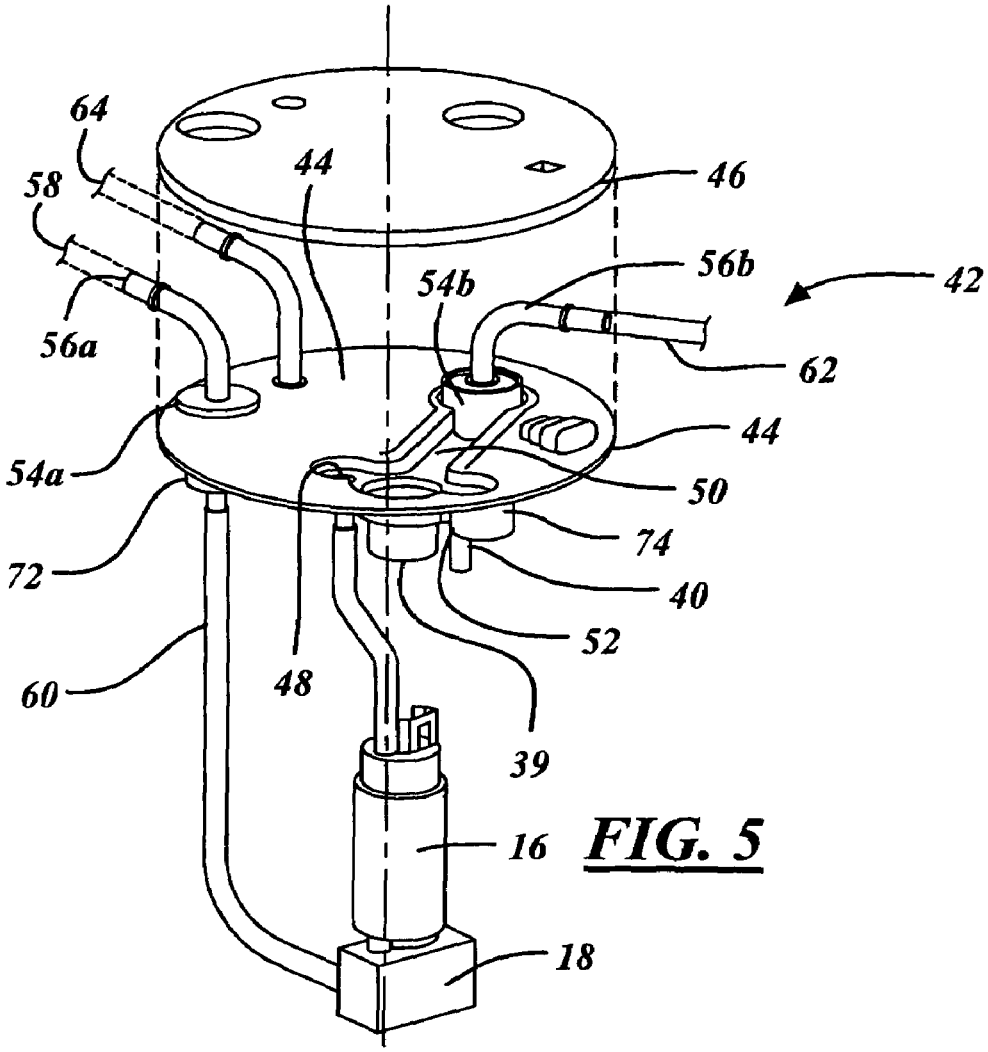
FIG. 5 is perspective view of the assembled components disposed within a reservoir in accordance with the present invention.

With reference to FIGS. 4 and 5, fuel system 10, and more particularly, reservoir 14, further comprises a top 42. In the illustrated embodiment, top 42 is comprised of a fuel manifold 44 and a cover 46 that are coupled together, such as, for exemplary purposes only, by brazing, to create a plurality of closed fuel flow paths therein. As illustrated in FIGS. 4 and 5, fuel manifold 44 includes a fuel flow channel stamped therein that is divided by regulator receptacle 39 to create three separate fuel paths. When fuel regulator 38 is inserted into receptacle 39, it serves to seal off the three resulting fuel paths from one another.

FIG. 4 shows a first fuel path 48 that allows fuel to flow from fuel pump outlet 32 to an inlet of fuel regulator 38; a second fuel path 50 to allow to flow from an outlet of regulator 38 to engine 20; and a third fuel path 52 to allow excess fuel not supplied to engine 20 by regulator 38 to flow from regulator bypass outlet 40 into cavity 28. It should be noted, however, that in an alternate embodiment, more or less than three fuel flow paths can be provided.

Manifold 44 further includes a plurality of outlet apertures 54 therein and corresponding connectors 56 to allow for the coupling of fuel lines for fuel tank 12 and engine 20 to reservoir 14 and the components housed therein. For example, with reference to FIG. 4, manifold 44 includes aperture 54*a* and corresponding connector 56*a* to allow for a fuel line 58 (shown in phantom lines) from tank 12 to be connected to a fuel line 60 disposed inside housing 26 that is coupled to inlet 34*a* of valve 18. Manifold 44 also includes aperture 54*b* and corresponding connector 56*b* to allow for fuel to flow from fuel path 50, to engine 20. Connector 56*b* is configured for coupling with a fuel feed line 62 (shown in phantom lines) of engine 20. In a preferred embodiment, manifold 44 still further includes aperture 54*c* and corresponding connector 56*c* to allow excess fuel from reservoir 14 to flow to fuel tank 12 when reservoir 14 reaches capacity as a result of excess fuel from regulator 38 being fed into reservoir 14. This allows for any vapor created in reservoir 14, or from pump 16 or regulator 38, to be flushed out of cavity 28. Accordingly, connector 56*c* is configured for connection with a fuel return line 64 (shown in phantom lines), which, in turn, is connected to a fuel inlet 65 (not shown) of tank 12.

With continued reference to FIG. 4, manifold 44 further includes an electrical receptacle 66. Receptacle 66 is provided for connection to a power supply (not shown) to operate fuel pump 16.

Figure 6:
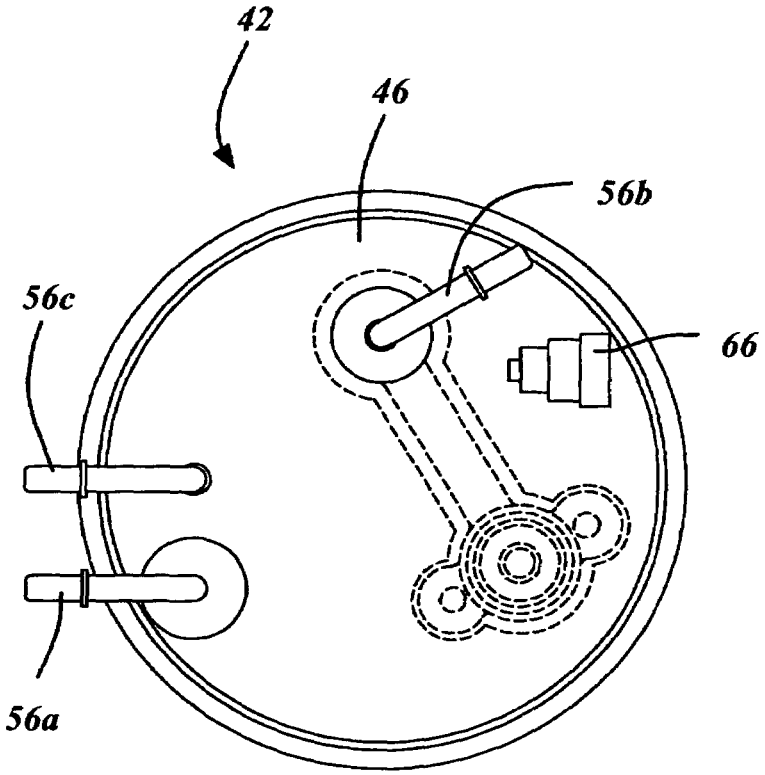
FIG. 6 is a top plan view of a reservoir having a cover disposed thereon in accordance with the present invention.

With reference to FIGS. 5 and 6, cover 46 of reservoir top 42 is sized and shaped substantially the same as manifold 44 so as to be placed on top of manifold 44 and secured thereto. In a preferred embodiment, manifold 44 and cover 46 are brazed together. However, those skilled in the art will recognize that other methods and processes can be used to couple manifold 44 and cover 46 together, such as, for exemplary purposes only, laser welding. Cover 46 also includes apertures therein that correspond to the apertures 54*a*, 54*b*, and 54*c* when cover 46 is properly aligned with manifold 44. When assembled together, cover 46 covers and encloses the stamped fuel paths in manifold 44, thereby serving to create closed fuel flow paths. Additionally, the combination of manifold 44 and cover 46 serve to seal reservoir 14, and cavity 28 in particular, from the surrounding environment.

Top 42 and the components thereof can be constructed of one or more of any number of materials. In a preferred embodiment, manifold 44 and cover 46 are formed of stainless steel, however, the present invention is not intended to be so limited. Rather, manifold 44 and cover 46 may be formed of other types of metal, such as aluminium or the like, or other types of materials that are both impermeable by, and immune to, hydrocarbons. Additionally, top 42 can be coupled to housing 26 in any given number of ways. For example, top 42 may be bolted down onto housing 26, can be held and secured in place by way of a cam lock ring, or a c-clip and groove combination may be used.

In a preferred embodiment, fuel system 10 still further includes a cooling system for reservoir 14 (best shown in FIG. 2). More particularly, fuel system 10 comprises a cooling jacket 68 that is disposed about at least a portion of housing 26 of reservoir 14. In one preferred embodiment, cooling jacket 68 comprises a water jacket that is connected to a water supply 70. In this embodiment, cooling water is circulated through at least one channel 71 in the cooling jacket to facilitate heat transfer from the housing and fuel therein to the water which is continuously circulated. In an exemplary embodiment, water supply 70 is the cooling water supply for engine 20, however, any other source of water, including a dedicated closed loop or open looped water supply, will suffice. Additionally, cooling jacket 68 need not necessarily employ water to cool reservoir 14 and the fuel stored therein. Rather, any other type of liquid or substance that is able to cool reservoir 14 may be used in place of water, and therefore, is intended to be within the spirit and scope of the present invention. Cooling jacket 68 may be formed of metal, such as, for exemplary purposes only, aluminium or stainless steel. It should be noted, however, that cooling jacket 68 may be oncsturcted of other types of metals, or materials other than metal, that are operative to carry out the same functionality.

With reference to FIG. 2, in a preferred embodiment, fuel system 10 yet still further includes a water separating filter 72. Water separating filter 72 includes an inlet and an outlet and is disposed between fuel tank 12 and inlet 34*a* of valve 18, and thus, inlet 30 of fuel pump 16. Water separating filter 72 is operative to remove any water that may have mixed with the fuel in tank 12 as a result of condensation forming in tank 12 or that has otherwise entered the fuel system. In the illustrated embodiment, water separating filter 72 is mounted within housing 26 of reservoir 14 and is connected on one side to the fuel tank outlet 24 and on the other to valve inlet 34*a*. More particularly, in the illustrated embodiment water separating filter 72 is connected between connector 56*a* and fuel supply line 60. However, in an alternate embodiment, water separating filer 72 may be mounted external to reservoir 14. In a preferred embodiment, water separating filter 72 includes a removable water containment cup that serves to collect the water removed from the fuel passing through filter 72.

With continued reference to FIG. 2, a preferred embodiment of fuel system 10 yet still further includes a fuel filter 72 that is operative to filter out particulate contaminates such as, for example, dirt, rust and/or other types of materials in the fuel supplied to engine 20. Fuel filter 74 may be an permanent component of fuel system 10, however, in a preferred embodiment, filter 74 is a replaceable filter. In the illustrated embodiment, filter 74 includes and inlet and an outlet, is disposed between fuel pump outlet 32 and engine 20, and is mounted within housing 26 of reservoir 14. As such, filter 74 is operative to filter the fuel supplied to engine 20 by fuel pump 16. However, in an alternate embodiment, fuel filter 74 may be external to reservoir 14 and positioned between connector 56*b* and engine 20. In still another embodiment, filter 74 may be positioned between fuel tank 12 and fuel pump 16. Accordingly, those skilled in the art will recognize that arrangements of filter 74 within fuel system 10 other than the arrangement employed in the preferred embodiment of the present invention remain within the spirit and scope of the present invention.

While the invention has been particularly shown and described with reference to the preferred embodiments thereof, it is well understood by those skilled in the art that various changes and modifications can be made in the invention without departing from the spirit and scope of the invention.

I claim:

1. A fuel system, comprising:

a fuel tank having an outlet;

a reservoir having a housing defining a cavity therein, said reservoir located remotely from said fuel tank, said reservoir configured to receive and store fuel therein;

a fuel pump configured to supply fuel from one of said fuel tank and said reservoir to an engine, said fuel pump including an inlet and an outlet; and a valve including a fuel tank inlet port, a reservoir inlet port, and an outlet port wherein said fuel tank inlet port is in fluid communication with said fuel tank, said reservoir inlet port is in fluid communication with said reservoir, said outlet port is configured to be connected to and in fluid communication with said fuel pump, and wherein said valve is configured to couple said outlet port with said reservoir inlet port and decouple said fuel tank inlet port with said outlet port when predetermined conditions occur indicative of fuel vapor or air in said fuel tank inlet port.

2. A fuel system in accordance with claim 1 further comprising a cooling jacket disposed about said housing of said reservoir operative to cool said reservoir and the fuel stored therein.

3. A fuel system in accordance with claim 2 wherein said cooling jacket is a water jacket that is coupled to a water supply.

4. A fuel system comprising:

a fuel tank having an outlet;

a reservoir having a housing defining a cavity therein, said reservoir located remotely from said fuel tank, said reservoir configured to receive and store fuel therein, and wherein said reservoir further comprises a fuel manifold disposed at the top of said reservoir having a plurality of fuel flow paths stamped therein;

a fuel pump configured to supply fuel from one of said first fuel tank and said reservoir to an engine, said fuel pump including an inlet and an outlet; and a valve including a fuel tank inlet port, a reservoir inlet port, and an outlet port wherein said fuel tank inlet port is in fluid communication with said fuel tank, said reservoir inlet port is in fluid communication with said reservoir, said outlet port is configured to be connected to and in fluid communication with said fuel pump, and wherein said valve is configured to couple said outlet port with said reservoir inlet port when predetermined conditions occur indicative of fuel vapor or air in said fuel tank inlet port.

5. A fuel system in accordance with claim 4 wherein said plurality of paths includes a first path to allow fuel to flow from said fuel pump to a fuel regulator, a second path to allow fuel to flow to from said fuel regulator to said engine and a third path to allow fuel to flow from said fuel regulator to said reservoir.

6. A fuel system in accordance with claim 4 wherein said fuel manifold comprises:

a first outlet configured to connect said fuel pump to said paths in said manifold, and therefore, indirectly to said engine;

a second outlet configured to connect said reservoir to said fuel tank to provide a fuel return path from said reservoir to said fuel tank; and an inlet configured to connect said inlet of said pressure valve to said outlet of said fuel tank.

7. A fuel system in accordance with claim 4 further comprising an upper cover disposed on top of and secured to said fuel manifold so as to create closed fuel flow passages and to seal said reservoir.

8. A fuel system in accordance with claim 4 wherein said fuel manifold further comprises an electrical connector configured to electrically connect said fuel pump to a power supply.

9. A fuel system, comprising:

a fuel tank configured to store fuel therein, said fuel tank having an inlet and an outlet;

a reservoir having a housing defining a cavity therein, said reservoir located remotely from said fuel tank, said reservoir configured to receive and store fuel therein;

a cooling jacket disposed about said reservoir operative to cool said reservoir and the fuel stored therein;

a fuel pump disposed and mounted within said housing of said reservoir configured to supply fuel from one of said fuel tank and said reservoir to an engine, said fuel pump including an inlet and an outlet; and a valve including a fuel tank inlet port, a reservoir inlet port, and an outlet port wherein said fuel tank inlet port is in fluid communication with said fuel tank, said reservoir inlet port is in fluid communication with said reservoir, said outlet port is configured to be connected to and in fluid communication with said fuel pump, and wherein said valve is configured to couple said outlet port with said reservoir inlet port and decouple said fuel tank inlet port with said outlet port when predetermined conditions occur indicative of fuel vapor or air in said fuel tank inlet port.

10. A fuel system comprising:

a fuel tank configured to store fuel therein, said fuel tank having an inlet and an outlet;

a reservoir having a housing defining a cavity therein, said reservoir located remotely from said fuel tank, said reservoir configured to receive and store fuel therein, wherein said reservoir further comprises a fuel manifold disposed at the top of said reservoir having a plurality of fuel flow paths stamped therein;

a cooling jacket disposed about said reservoir operative to cool said reservoir and the fuel stored therein;

a fuel pump disposed and mounted within said housing of said reservoir configured to supply fuel from one of said fuel tank and said reservoir to an engine, said fuel pump including an inlet and an outlet; and a valve including a fuel tank inlet port, a reservoir inlet port, and an outlet port wherein said fuel tank inlet port is in fluid communication with said fuel tank, said reservoir inlet port is in fluid communication with said reservoir, said outlet port is configured to be connected to and in fluid communication with said fuel pump, and wherein said valve is configured to couple said outlet port with said reservoir inlet port when predetermined conditions occur indicative of fuel vapor or air in said fuel tank inlet port.

11. A fuel system in accordance with claim 10 wherein said plurality of paths includes a first path to allow fuel to flow from said fuel pump to a fuel regulator, a second path to allow fuel to flow to from said fuel regulator to said engine and a third path to allow fuel to flow from said fuel regulator to said reservoir.

12. A remotely mounted fuel system, comprising:

a reservoir having a housing configured to receive and store fuel therein;

a fuel pump disposed and mounted within said housing of said reservoir configured to supply fuel to an engine from one of said reservoir and a remotely located fuel tank, said fuel pump including an inlet and an outlet; and a valve including a fuel tank inlet port, a reservoir inlet port, and an outlet port wherein said fuel tank inlet port is in fluid communication with said fuel tank, said reservoir inlet port is in fluid communication with said reservoir, said outlet port is configured to be connected to and in fluid communication with said fuel pump, and wherein said valve is configured to couple said outlet port with said reservoir inlet port and decouple said fuel tank inlet port with said outlet port when predetermined conditions occur indicative of fuel vapor or air in said fuel tank inlet port.

13. A fuel system in accordance with claim 12 further comprising a cooling jacket disposed about said housing of said reservoir operative to cool said reservoir and the fuel stored therein.

14. A fuel system in accordance with claim 13 wherein said cooling jacket comprises a water jacket that is coupled to a water supply.

15. A remotely mounted fuel system comprising:

a reservoir having a housing configured to receive and store fuel therein, wherein said reservoir further comprises a fuel manifold disposed at the top of said reservoir having a plurality of fuel flow paths stamped therein;

a fuel pump disposed and mounted within said housing of said reservoir configured to supply fuel to an engine from one of said reservoir and a remotely located fuel tank, said fuel pump including an inlet and an outlet; and a valve including a fuel tank inlet port, a reservoir inlet port, and an outlet port wherein said fuel tank inlet port is in fluid communication with said fuel tank, said reservoir inlet port is in fluid communication with said reservoir, said outlet port is configured to be connected to and in fluid communication with said fuel pump, and wherein said valve is configured to couple said outlet port with said reservoir inlet port when predetermined conditions occur indicative of fuel vapor or air in said fuel tank inlet port.

16. A fuel system in accordance with claim 15 wherein said plurality of paths includes a first path to allow fuel to flow from said fuel pump to a fuel regulator, a second path to allow fuel to flow from said regulator to said engine and a third path to allow fuel to flow from said fuel regulator to said reservoir.

17. A fuel system in accordance with claim 15 wherein said fuel manifold comprises:

a first outlet configured to connect said fuel pump to said paths in said manifold, and therefore, indirectly to said engine;

a second outlet configured to connect said reservoir to said fuel tank to provide a fuel return path from said reservoir to said fuel tank; and an inlet configured to connect said inlet of said pressure valve to said outlet of said fuel tank.

18. A fuel system in accordance with claim 15 further comprising an upper cover disposed on top of and secured to said fuel manifold so as to create closed fuel flow passages and to seal said reservoir.

19. A fuel system in accordance with claim 15 wherein said fuel manifold further comprises an electrical connector configured to electrically connect said fuel pump to a power supply.

* * * * *